US005088149A

United States Patent [19]

Berg et al.

[11] Patent Number: 5,088,149

[45] Date of Patent: Feb. 18, 1992

[54] VACUUM POWERED SCRUB HEAD

[75] Inventors: David W. Berg, Plymouth; David J. Brenner, Eden Prairie; Ronald W. Lehman, Brooklyn Park; Bruce W. Forsman, Plymouth, all of Minn.

[73] Assignee: Tennant Company, Minneapolis, Minn.

[21] Appl. No.: 562,800

[22] Filed: Aug. 6, 1990

[51] Int. Cl.[5] ..... A47L 7/00

[52] U.S. Cl. ..... 15/322; 15/321; 15/328; 15/387

[58] Field of Search ..... 15/321, 322, 334, 387, 15/328

[56] References Cited

U.S. PATENT DOCUMENTS

| | | | |
|---|---|---|---|
| 1,975,380 | 10/1934 | Streich et al. | 15/50 |
| 2,246,111 | 6/1941 | Snyder | 15/50 |
| 3,044,100 | 7/1962 | Zaidan | 15/387 |
| 3,206,787 | 9/1965 | Daniels et al. | 15/320 |
| 3,699,607 | 10/1972 | Putt | 15/320 |
| 4,167,798 | 9/1979 | Klügl et al. | 15/334 |
| 4,272,861 | 6/1981 | Notta | 15/320 |
| 4,305,176 | 12/1981 | Lessig, III et al. | 15/387 |
| 4,306,330 | 12/1981 | Jinkins | 15/325 |
| 4,369,544 | 1/1983 | Parisi | 15/320 |
| 4,596,061 | 6/1986 | Henning | 15/322 |
| 4,658,464 | 4/1987 | Sharp | 15/321 |
| 4,817,233 | 4/1989 | Waldhauser | 15/320 |
| 4,893,375 | 1/1990 | Girman et al. | 15/321 |
| 4,974,618 | 12/1990 | Nysted | 15/321 |

OTHER PUBLICATIONS

1 Page "The Right Tool for Every Job"—Clarke.

Tennant Trend Bulletin "Quality You Can Count On" FLC-888-700.

*Primary Examiner*—Philip R. Coe

*Assistant Examiner*—Reginald L. Alexander

*Attorney, Agent, or Firm*—Kinzer, Plyer, Dorn, McEachran & Jambor

[57] ABSTRACT

An improved scrub head for a cleaning wand to be used with a floor cleaning machine. The scrub head is supplied with vacuumized air and pressurized cleaning solution through the wand from the machine. The scrub head has a nozzle for applying cleaning solution to the floor, a powered rotating tool such as a brush or a pad for scrubbing the floor, and a vacuum pickup shoe or squeegee for picking up soiled cleaning solution. The squeegee, when used, has flexible lips of a novel and improved design. The rotating tool is driven by an air turbine which takes in its air from essentially clean ambient atmosphere, and a valve selectively and automatically connects the vacuumized air to either the turbine outlet, thus causing the turbine and tool to rotate for scrubbing the floor, or to the pickup shoe or squeegee for picking up soiled cleaning solution and debris.

12 Claims, 5 Drawing Sheets

VACUUM POWERED SCRUB HEAD

BACKGROUND OF THE INVENTION

The floors in commercial and industrial buildings get dirty with use and require periodic cleaning, so various cleaning machines have been developed and are available for this purpose. Aisles and corridors are often cleaned with a battery powered scrubber which has one or more scrub brushes or pads, tanks for clean and dirty scrub water and a vacuum pickup shoe or squeegee. A rigid pickup shoe is generally used when cleaning carpet, while a pickup squeegee with flexible lips is needed when cleaning hard floors such as tile or concrete.

Many off-aisle areas are too small for passage of these machines, and areas under counters, furniture, etc. are also inaccessible to them. Hand held equipment has evolved for cleaning these less accessible and smaller areas. Commonly this will be a tubular wand of a convenient length for a standing operator to hold and reach to the floor. The lower end will be connected to some sort of cleaning head. These heads vary in design. Some are only a vacuum pickup nozzle. Others add a floor brush to the vacuum pickup. This brush may be stationary, requiring manual pushing, or it may rotate or oscillate under power. Some cleaning heads spray cleaning solution on the floor and pick it up with the vacuumized air, and may or may not have a brush. In all these cases the upper end of the wand will be attached to a hose which is connected to a source of vacuumized air and either a wet or a dry debris receptacle, and it may also be connected to a smaller hose which supplies it with pressurized cleaning solution. The wand will comprise a rigid main tube which carries the vacuumized air from the scrub head, and in a design using cleaning solution the wand will also have a smaller tube along its length to carry the solution to the scrub head.

We are concerned here with a scrub head for use with a wand, the scrub head being of the type which has a powered rotating tool such as a brush or pad to scrub and loosen soilage on a floor or other surface. It is supplied at the will of the operator with pressurized cleaning solution, which is most commonly water to which a detergent has been added, and it has means for applying the solution to the floor, for example, a spray nozzle. It also has a vacuumized pickup shoe or squeegee. Such scrub heads commonly have an electric motor to drive the rotating tool. This motor makes the scrub head heavy, and since it is on the end of a rather long wand an operator must make a substantial and fatiguing effort to operate it. A electric motor also adds substantially to the cost of a scrub head and potentially can create an electric shock hazard. Prior art squeegee lips are also candidates for improvement. They are typically rather complex assemblies of rubber strips and metal retainers held together by screws. These shortcomings of prior art scrub heads are addressed by the present invention.

SUMMARY OF THE INVENTION

The present invention comprises a relatively lightweight scrub head made mostly of molded plastic parts for use with a lightweight tubular wand. This tubular wand is preferably made of molded plastic, but may be metal. A hand valve at the upper end of the wand controls delivery of cleaning solution to the scrub head, where there is a spray nozzle or other means for applying it to the floor. The scrub head also has a rotating tool which may be a scrub brush or pad and a vacuum pickup shoe or squeegee. However, it has no electric motor. Rather, the brush is driven by a light weight, molded plastic air turbine. Air is drawn through this turbine by the vacuum available to the scrub head through the tubular wand. The turbine takes its intake air from the ambient air around the scrubber, which is essentially clean, so the turbine does not get clogged with debris. The operator can apply cleaning solution to the floor and at the same time agitate it with the rotating tool to loosen and dissolve soilage from the floor. He or she can then stop the flow of cleaning solution with the hand valve on the upper end of the wand, and in the preferred embodiment that action will cause a pressure operated valve in the scrub head to automatically switch the vacuum from pulling air through the turbine to pulling air through the pickup shoe or squeegee. The flow of fresh cleaning solution and the rotation of the turbine and tool will cease, and the operator can pick up the soiled cleaning solution and loosened debris using the vacuum pickup shoe or squeegee. In operation, while solution is being delivered to the floor the automatic valve is held in position to connect vacuumized air to the turbine by pressure in the cleaning solution line which is delivered to the valve and which overcomes an opposing spring in the valve. When delivery of solution is shut off there is no longer any pressure in the solution line, and the spring moves the valve into position to connect vacuumized air to the pickup. shoe or squeegee. There is also a foot pedal control on the scrub head which can lock out the spring in the automatic valve and hold the valve in position to pull air through the turbine even though the flow of cleaning solution has been shut off. It gives the operator the option to continue running the rotating tool if desired after shutting off the cleaning solution and before starting the vacuum pickup.

An alternative embodiment is also described in which a manual valve replaces the automatic valve. The manual valve is operated by the person running the machine, who pushes it to either of two positions with one foot, thereby activating either the air turbine or the pickup squeegee.

The turbine powered scrub head is lighter in weight than an equivalent electric powered model, so the operator can use it with less fatigue. It is also lower in cost than an equivalent electric model, mainly due to the simplicity of the molded plastic turbine compared to the complexity of an electric motor that would do the same job. The unique air valving isolates the turbine from the contaminated airflow out of the vacuum pickup squeegee and permits it to run on relatively clean ambient air so it performs very reliably, requiring less service attention than an electric motor would. Since no electricity is used in the scrub head there is no need for electrical wires leading to it, which further simplifies the design, reduces the cost and eliminates any possibility of electric shock.

The scrub head can be built in one version with a rigid pickup shoe for use on carpeted floors, or in another version it can be built equipped with a pickup squeegee having flexible lips for use on hard surface floors. In connection with the latter version a novel and improved design of flexible squeegee lip is disclosed. It is a one piece design which is made from a two durometer plastic extrusion. It reduces the number of parts typically needed in a squeegee, with attendant cost economies.

DETAILED DESCRIPTION OF THE INVENTION

Figure 1:
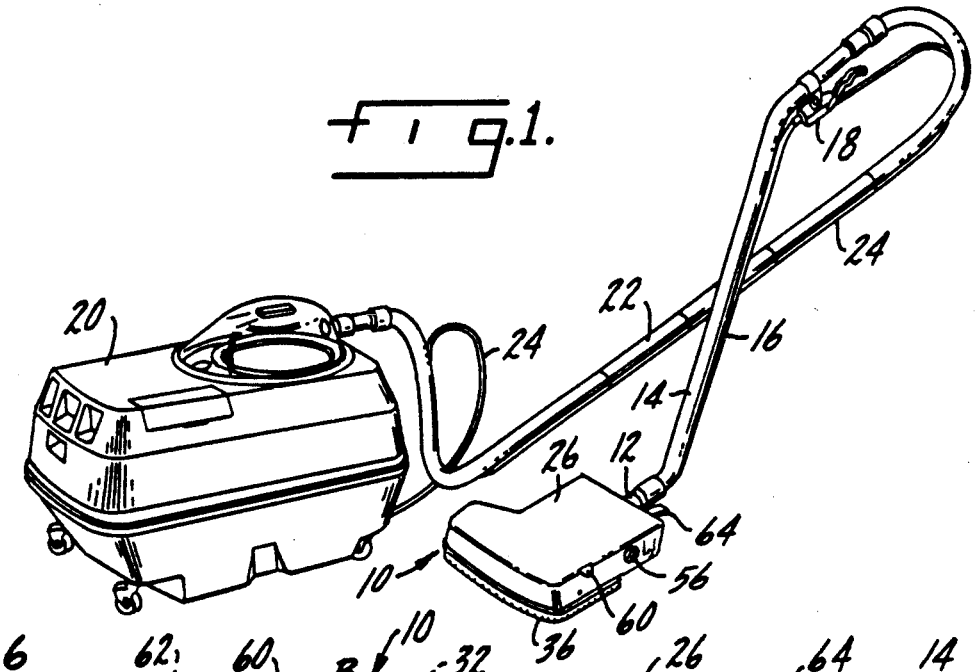
FIG. 1 is a perspective view of the scrub head of the present invention attached to a wand which is connected to a source of vacuumized air and pressurized cleaning solution as it might appear when set up ready for use.

In FIG. 1 the improved scrub head which is the subject of this invention is shown generally at 10 as set up and ready for use in scrubbing a floor. It is connected at 12 with a detachable, swiveling connection to a tubular wand 14 by means of which an operator can move the scrub head over a surface to be scrubbed. The wand 14 is preferably made of molded plastic, but may be made of formed metal tubing. A small diameter cleaning solution feed line 16 extends along the length of the wand. At its lower end it is connected to the scrub head with a snap-on connection and at its upper end it is connected to a hand valve 18 which is attached to the wand.

At 20 is shown a unit which supplies the scrub head with liquid cleaning solution under pressure and vacuumized air for driving the turbine and removing soiled solution. Unit 20 also stores soiled solution until it can be disposed of. Unit 20 as illustrated is a carpet extractor such as that disclosed in U.S. Pat. No. 4,586,208, but it could be otherwise. Any unit capable of supplying pressurized cleaning solution, vacuumized air and storage for soiled solution would be suitable. Many floor scrubbers could do the job. It would also be possible to use a wet-or-dry shop vacuum cleaner to supply the vacuumized air and store the soiled solution. Then tap water from a common faucet could be used as the pressurized cleaning solution. The components of the scrub head are designed to be compatible with the usual range of city water pressure.

There is an intermediate vacuum hose 22 with a small diameter hose 24 secured along it. The vacuum hose 22 is connected with push-on connections to the unit 20 and the wand 14. The small diameter hose 24 carries cleaning solution under pressure, and is connected to the unit 20 and to the hand valve 18 with snap-on connections.

Figure 2:
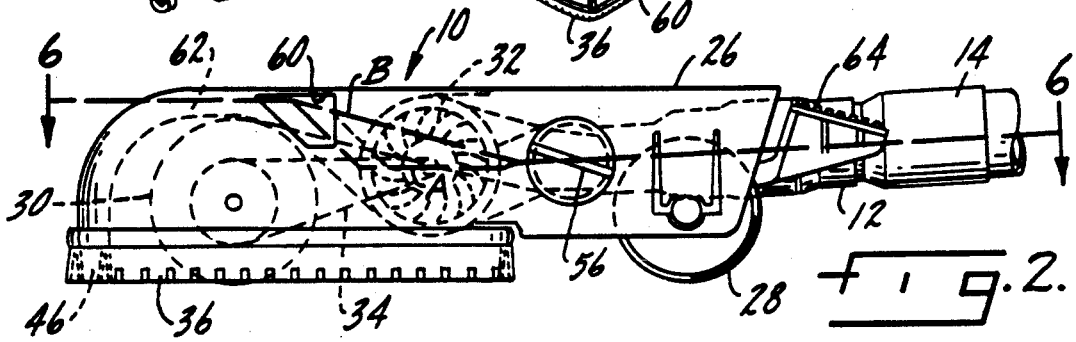
FIG. 2 is a left side view of the scrub head with certain internal features generally indicated.

FIG. 2 shows a left side view of the improved scrub head which is shown generally at 10 in FIG. 1. Two free rolling wheels 28 support the rear of the scrub head. Within the housing a rotating cylindrical scrub brush or pad 30 is driven by a vacuum turbine 32 through a belt drive 34. Scrub water which is applied to the floor under the scrub head is contained by a flexible skirt 36, shown also in FIGS. 1 and 3.

Figure 5:
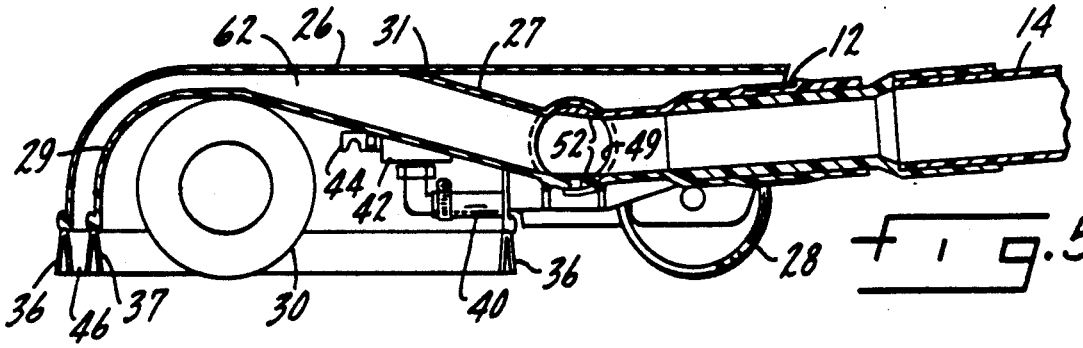
FIG. 5 is a sectional view of the scrub head taken on line 5—5 of FIG. 3.
Figure 8:
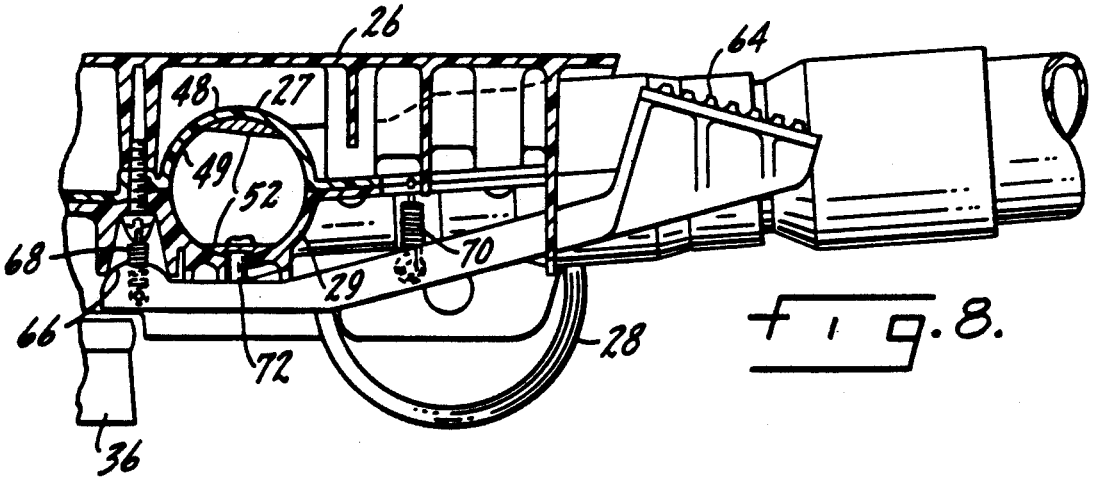
FIG. 8 is a partial sectional view of the scrub head taken on line 8—8 of FIG. 3, with certain parts broken out for clarity.

The plastic housing of the scrub head is molded in three parts, as perhaps best seen in FIG. 8. There is a housing cover 26, a housing top 27 and a housing base 29. The three parts are joined together with screws. Several of the principal parts of the scrub head are integral parts of the housing. These include the valve housing 48, the housing for the turbine 32, the frame of the pickup squeegee 46 to which the squeegee blades are attached, and air passages connecting the wand 14 with the valve, and the valve with the turbine and the pickup squeegee. A gasket 31 shown in FIG. 5 seals the air passages where the housing parts come together to form air passages.

Figure 3:
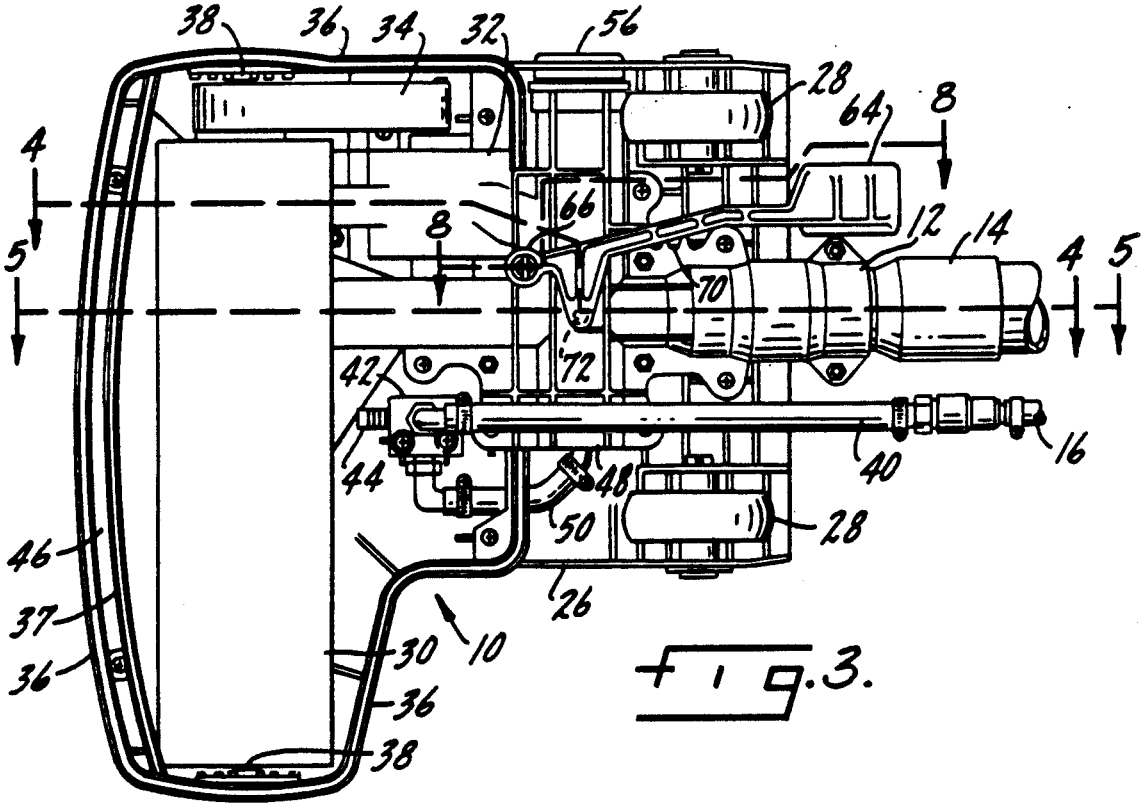
FIG. 3 is a bottom view of the scrub head.
Figure 4:
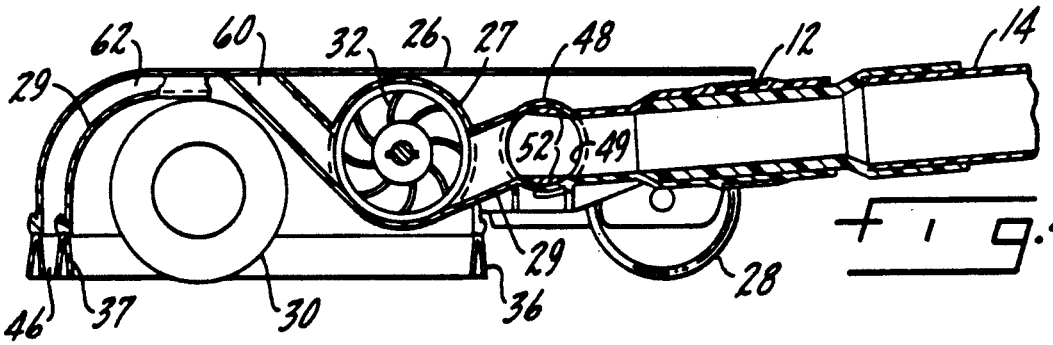
FIG. 4 is a sectional view of the scrub head taken on line 4—4 of FIG. 3.

In FIG. 3, which is a bottom view, the scrub brush 30 is represented by a rectangle, but it should be understood that it is a conventional cylindrical scrub brush. It is mounted for rotation on end bearings 38, and is driven by vacuum turbine 32 through cog belt 34. Cleaning solution from solution tube 16 passes through intermediate tube 40 into connector block 42. Spray nozzle 44 is screwed into the connector block and delivers the cleaning solution to the floor. It can be seen in FIG. 3 and part of the fourth to effectively contain cleaning solution under the scrub head.

A pickup squeegee 46 extends across the front of the scrub head. It is best visualized from FIGS. 3 and 5. The pickup squeegee frame is formed by housing cover 26 and housing base 29 across the front of the scrub head. Attached to this frame are flexible squeegee blades which seal ambient air out of the squeegee area, admit soiled scrubbing solution into the pickup squeegee, and wipe the floor damp dry. The portion of skirt 36 which passes across the front of the scrub head serves as one squeegee blade or lip. A second squeegee blade or lip 37 completes the enclosure of the pickup squeegee 46.

Various designs of squeegee blades are known in the art, and no doubt a number of them might serve in this scrub head. However, a preferred construction for such blades has been found which is advantageously used here and might also be useful with pickup squeegees on many floor scrubbers.

Figure 11:
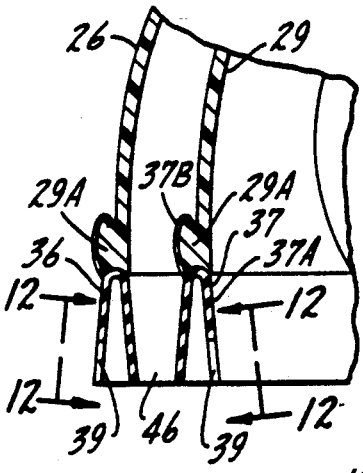
FIG. 11 is a fragment from FIG. 5 on an enlarged scale, showing the pickup squeegee.

Skirts 36 and 37 are basically alike, differing only in notching detail. Therefore a description of one will suffice for both. As shown in FIG. 11, squeegee blade or lip 37 is comprised of two parts, a lower part 37A in the shape of an inverted "V" and an upper hook-shaped part 37B. Both are made of a thermoplastic elastomer. The lower part 37A is approximately 55 Shore A durometer, and the upper part 37B is approximately 50

Figure 12:
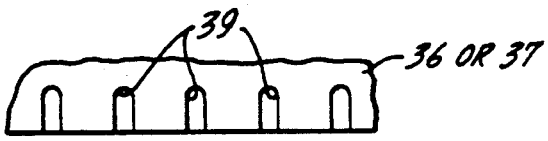
FIG. 12 is a view of a portion of the squeegee lips taken on either of view lines 12—12 in FIG. 11.

Shore D. The two parts are extruded together in one step by a well-known dual durometer extrusion process which joins them continuously along their lengths, making in effect a one-piece squeegee lip. Part 37A is a soft enough durometer that it is readily flexible and functions effectively as a squeegee lip to wipe across the floor being scrubbed. Part 37B is a harder durometer so that its hooked end can engage the shaped flange 29A at the bottom of housing base 29 or housing cover 26 and firmly hold the squeegee lip 37 in position. After extrusion the squeegee lips are cut to their proper lengths. Then notches 39 are made with a notching die in one leg of the inverted "V" of part 37A, as shown in FIGS. 11 and 12.

Figure 13:
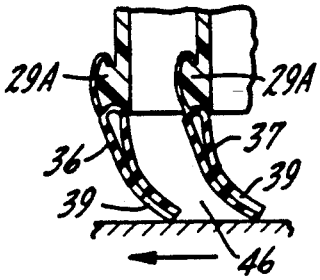
FIGS. 13 and 14 show schematically how the squeegee lips operate when the scrub head is moved forward or backward.
Figure 14:
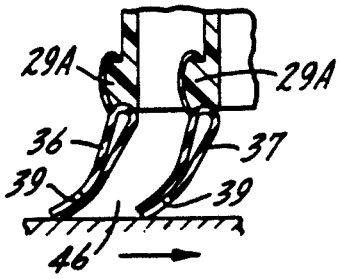

In use the squeegee lips 36 and 37 operate as shown schematically in FIGS. 13 and 14. When the scrub head is pushed to the left as indicated by the arrow in FIG. 13 both lips are bent as shown in FIG. 13. The notches in the leading lip 36 provide openings for water on the floor to pass into the central suction area of the pickup squeegee 46. The unnotched leg of trailing lip 37 presents a continuous edge to the floor to wipe it damp dry. The action of the lips is reversed when the scrub head is pulled backward as shown by the arrow in FIG. 14. Then lip 37 leads and admits water through its notches and lip 36 trails and wipes the floor dry. It will be noted that notches 39 are in the opposite legs of lips 37 and 36 relative to the hooked portion 37B. This is necessary to secure the described wiping action in forward and backward travel and still attach to shaped flanges 29A on the housing base and housing cover, both of which are on the forward side of their respective parts.

Figure 6A:
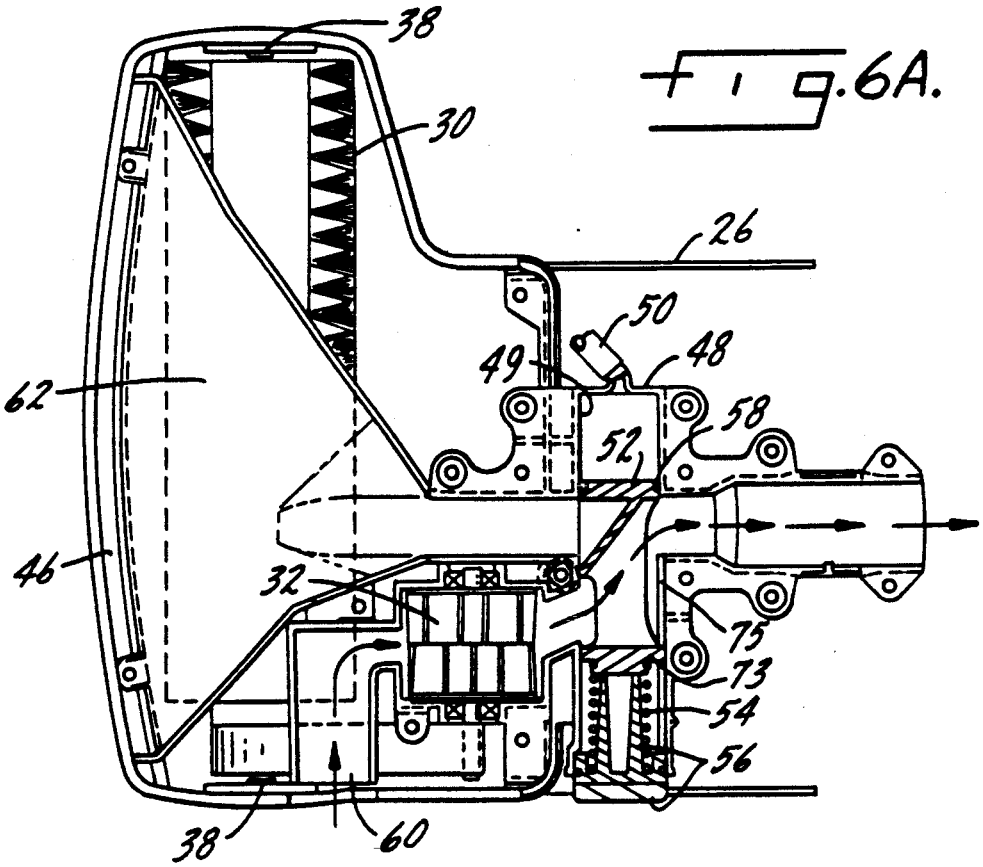
FIG. 6A is a sectional view of the scrub head taken on line 6-A-6 of FIG. 2 with airflow shown through the turbine.
Figure 6B:
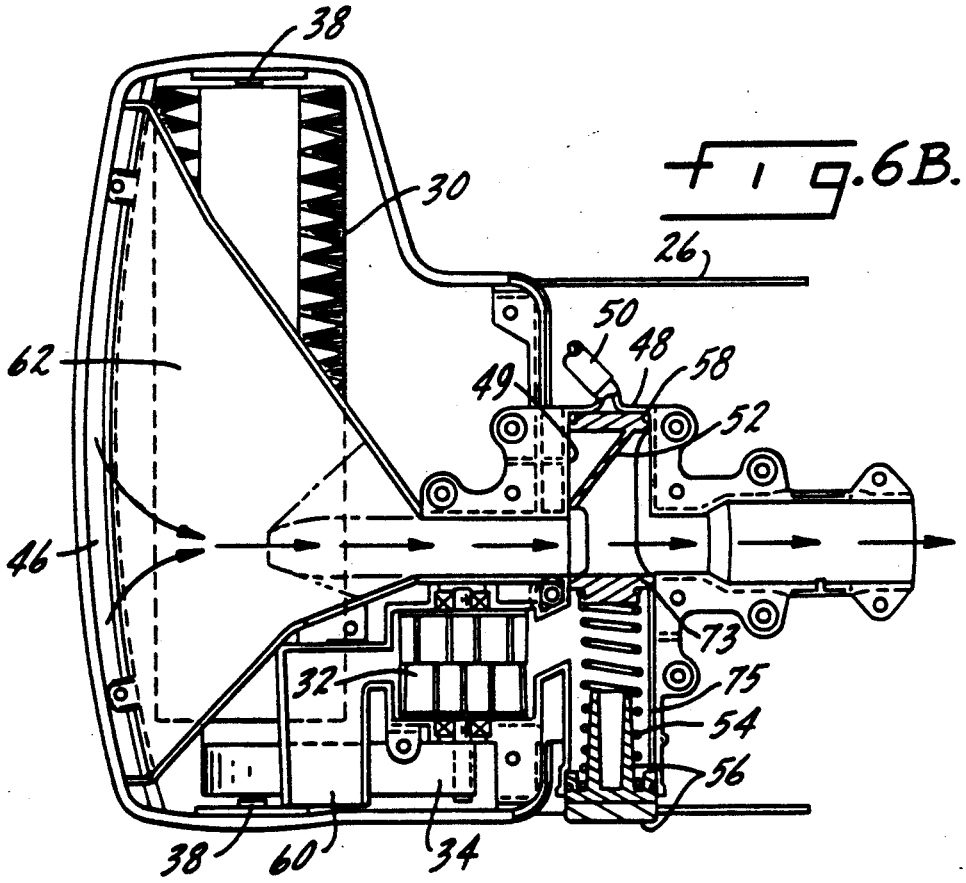
FIG. 6B is a sectional view of the scrub head taken on line 6-B-6 of FIG. 2 with airflow shown through the pickup squeegee.

It will be seen that when a squeegee lip such as 36 or 37 is folded over in operating position as shown in FIGS. 13 or 14 it will function in effect as a single lip which is notched half way through. Indeed, prior art squeegee lips have been made by molding a single lip having notches molded in for half the thickness of the lip. The present invention allows for manufacture by extrusion and low cost notching rather than by molding, thus saving substantially on cost. Further saving is effected at assembly, where the one-piece squeegee lip is merely snapped onto the supporting housing. Prior designs required assembling multiple parts with threaded fasteners A spool valve controls airflow in the scrub head. As best seen in FIGS. 6A and 6B there is a valve housing 48 which has a cylindrical cavity 49. One end of housing 48 is connected by tube 50 to connector block 42, best seen in FIG. 3. Fluid communication is thus established between the source of pressurized cleaning solution and the valve cavity 49. Within the valve housing cavity 49 are a sliding spool 52 and a compression spring 54 held in place by a retainer cap 56. The end of spool 52 nearest tube 50 serves as a piston, and is equipped with a U-cup seal 58 to seal against the pressure of the cleaning solution.

When hand valve 18 is opened, cleaning solution will flow under pressure through tubes 16 and 40 and connector block 42 to spray nozzle 44, which will spray it on the floor. The restriction in nozzle 44 will build up back pressure in block 42 which will force fluid through tube 50 to the cavity 49 in the valve housing 48. This pressurized fluid in the cavity will force spool 52 to compress spring 54 and move toward retainer cap 56 until spool 52 contacts cap 56 as shown in FIG. 6A. When hand valve 18 is closed, the flow of cleaning solution is shut off and there is no pressure in the system. Then spring 54 will push spool 52 away from cap 56 until the spool contacts the end of the cavity nearest tube 50 as shown in FIG. 6B.

When spool 52 is in the position shown in FIG. 6A air will be pulled through air turbine 32. This is ambient air from outside the scrub head, and it enters through air entry port 60. This will occur when cleaning solution is being sprayed on the floor under the scrub head, and in this mode turbine 32 will cause brush 30 to rotate, thus agitating the scrubbing solution being sprayed and effectively scrubbing the floor.

When spool 52 is in the position shown in FIG. 6B air will be pulled from the pickup squeegee 46 which extends across the front of the scrub head. There is a transitional air duct 62 which connects the pickup squeegee 46 with the valve housing 48. The vacuum in the wand is used in the pickup squeegee to suck up soiled cleaning solution from the floor, leaving it damp dry. In this mode the supply of cleaning solution is shut off and the turbine and brush do not run.

When a floor is unusually dirty it may be desirable to spray solution on the floor while agitating it with the brush, then shut off the flow of solution and continue to agitate the solution on the floor with the brush for a time before picking it up with the squeegee. This requires that valve spool 52 be held in the position shown in FIG. 6A and not allowed to move to the position shown in FIG. 6B when the cleaning solution flow is shut off by closing hand valve 18. For this purpose there is provided a foot lever 64. It is located so the operator's toe can place it in either of two positions.

As shown in FIG. 8, foot lever 64 is pivoted at a ball and socket joint 66, being held in this joint by spring 68. Lever 64 is held up in the position shown in FIG. 8 by spring 70. A pin 72 is secured to the lever. When the lever is in the position shown in FIG. 8 pin 72 will project through a hole in the wall of valve housing 48 and engage a recess in the bottom of valve spool 52. This recess in spool 52 is positioned so that pin 72 engages it when spool 52 is in the position shown in FIG. 6A. Pin 72 will thus prevent spool 52 from sliding when urged by spring 54 after the flow of cleaning solution has been shut off. This will keep the turbine and brush running and the pickup squeegee shut off even though the supply of cleaning solution has been stopped.

Figure 7:
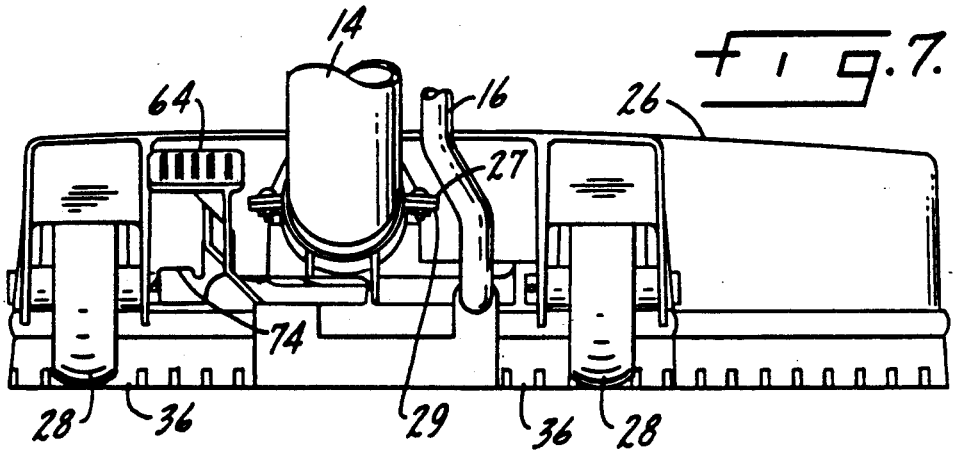
FIG. 7 is a rear view of the scrub head.

When the operator does not wish to operate in this mode he or she places a toe on lever 64, pushes it down, and moves it to the left. When the lever goes down, pin 72 will disengage from spool 52, allowing it to slide normally. When the depressed lever 64 is moved to the left, as seen in FIG. 7, it will pass under a detent 74 which is part of the rear wall of the scrub head housing 26. The lever may be released in this position and it will be held there by the detent 74. In this position pin 72 will not interfere with the automatic operation of sliding spool 52.

To assure proper alignment of spool 52 it is necessary that it does not rotate in cavity 49. To prevent rotation a small projection like a square key is molded on spool 52 and a keyway 75 is molded in the valve housing. These can be seen in FIGS. 6A and 6B. The projection 73 on the spool fits in the keyway 75. It allows the spool to slide freely but prevents it from rotating.

ALTERNATIVE VALVE CONSTRUCTION

Figure 9:
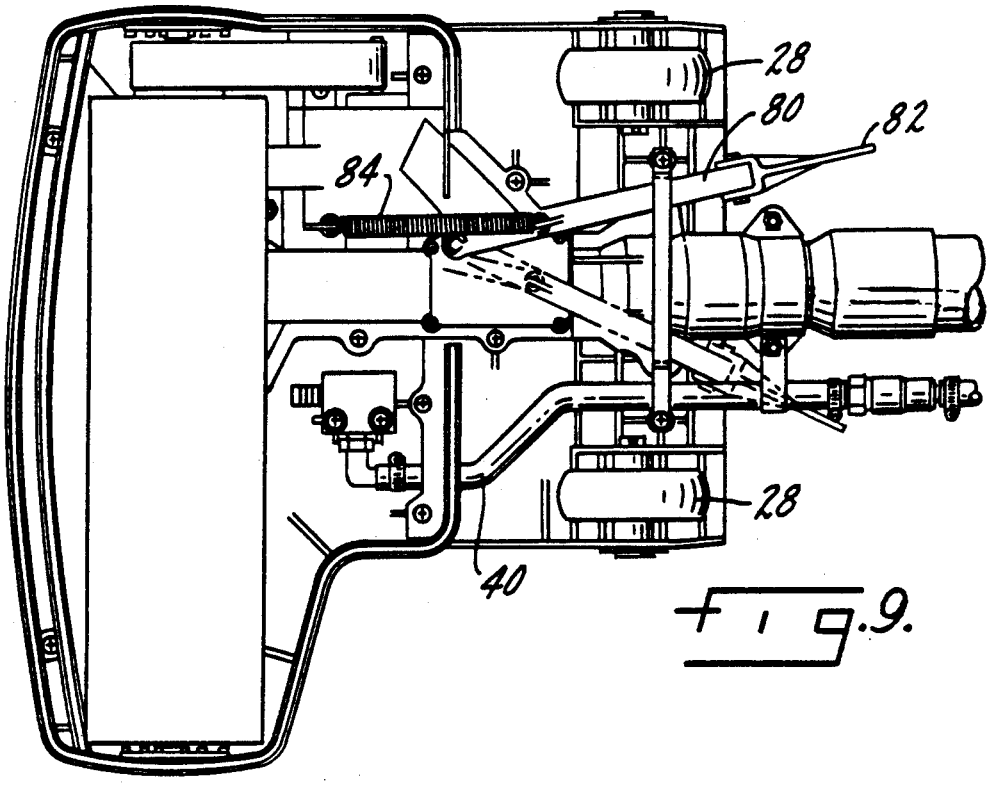
FIG. 9 is a bottom view of the scrub head showing an alternative construction.
Figure 10:
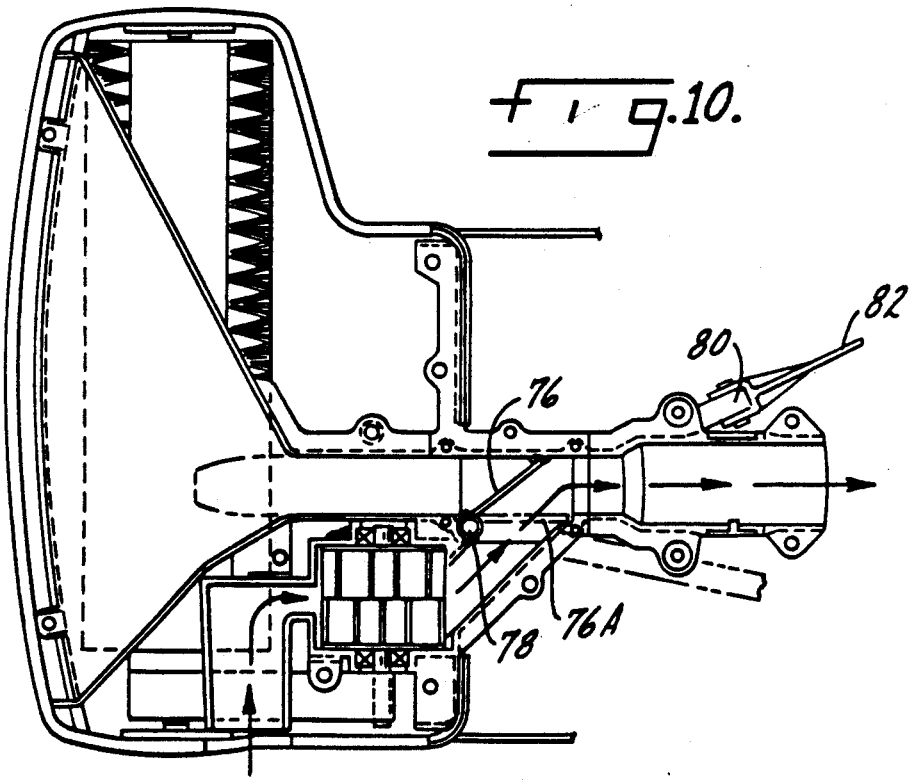
FIG. 10 is a sectional view of the scrub head similar to FIG. 6A showing the same alternative construction as shown in FIG. 9.

A simplified construction of the scrub head is shown in FIGS. 9 and 10. In the alternative construction the sliding spool valve operated by water pressure is replaced with a flap valve operated by a foot lever. As shown in FIG. 10 there is a valve plate 76 which is attached to and pivots with pivot pin 78. Valve plate 76 has two possible positions, a first position shown in solid lines and a second position 76A shown in dotted lines. The first position, shown in solid lines, will pass air through the turbine and shut off air from the pickup squeegee. The second position, shown in dotted lines, will admit air from the pickup squeegee and shut off air through the turbine. It thus serves the same function as the spool valve of the preferred embodiment.

Plate 76 is secured to pivot pin 78, which extends through the lower wall of the housing and is connected to foot lever 80, which has paddle 82 connected to it with a hinged joint. The hinged connection is needed because paddle 82 is quite close to the floor, and would dig into the floor when the scrub head is rocked back on wheels 28 if it weren't hinged. Paddle 82 is conveniently located for the operator to move with a toe from a first position shown in solid lines in FIG. 9 to a second position shown in dotted lines. Over center spring 84 will hold paddle 82 and lever 80 in whichever position the operator chooses. These first and second positions of paddle 82 and lever 80 correspond respectively with the first and second positions of valve plate 76.

ALTERNATIVE PICKUP SHOE

Figure 15:
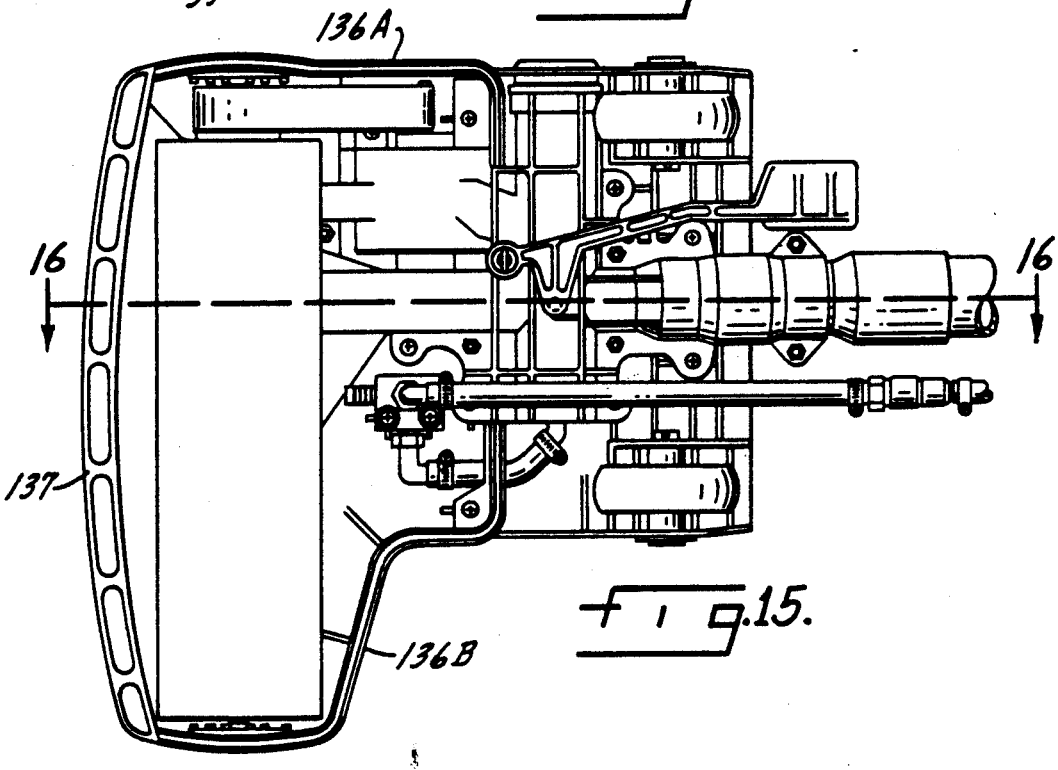
FIG. 15 is a bottom view similar to FIG. 3, but showing an alternative pickup shoe in place of a pickup squeegee.
Figure 16:
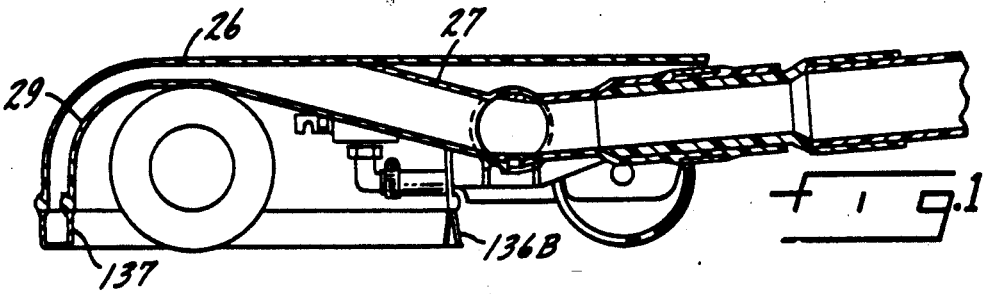
FIG. 16 is a sectional view taken on line 16—16 of FIG. 15 showing the alternative pickup shoe.

The pickup squeegee 46 is equipped with squeegee lips 36 and 37 and is suitable for picking up water off of a hard floor such as quarry tile or concrete. On a carpeted floor, however, the vacuum picks up water better if a hard walled pickup shoe is used instead of a pickup squeegee. Such a pickup shoe is shown in FIGS. 15 and 16. It will be seen that squeegee lips 36 and 37 have been replaced with shoe 137. This is a semi-rigid extrusion which may be snapped onto housing cover 26 and housing base 29 in place of squeegee lips 36 and 37. Shoe 137 is flexible enough to allow installation, but is essentially rigid in service. Its bottom surface comprises a series of slots separated by minimal stiffening ribs. These slots allow the passage of air and water out of a carpet being cleaned into the vacuum pickup system. Thus is formed a rigid walled pickup shoe, which works well on carpet because the carpet pile provides adequate sealing of the vacuum. Sealing skirts are still desirable around the sides and rear of the brush chamber to prevent water from being thrown out. These skirts are indicated as 136A and 136B in FIG. 15. They are the same as skirt 36 except for length, and they are located and work the same as skirt 36 except that they do not go across the front of the scrub head.

ALTERNATIVE TOOL CONSTRUCTION

The preferred embodiment utilizes a rotating brush or pad 30 as the tool for agitating cleaning solution on the floor. However, other forms of powered, movable tools are known for performing this function, and could be used here. For example, U.S. Pat. No. 4,272,861 shows a scrub head which has an electric motor that drives a brush in an arcuate, reciprocating motion. Such a brush motion could be used in the present invention by replacing the electric motor of U.S. Pat. No. 4,272,861 with an air turbine and providing an air valve and suitable ductwork to connect the valve to the turbine, a vacuum pickup and a source of vacuum. This construction, or any other arrangement of an air turbine driving a floor scrubbing tool,. would still embody the spirit of the present invention.

Whereas the preferred form and variations of the invention have been shown and described, it should be understood that suitable additional alterations, changes, substitutions and variations may be made without departing from the invention's fundamental theme. With this in mind it is desired that the inventive subject matter be unrestricted except by the appended claims.

The embodiments of the invention in which an exclusive property or privilege is claimed are defined as follows:

1. Apparatus for cleaning a floor, comprising a rotatable floor cleaning tool, means to controllably dispense cleaning solution to the floor for agitation by the tool, a vacuum pickup device for removing soiled cleaning solution from the floor, an air turbine in driving relationship with said cleaning tool and having an inlet connected to essentially clean ambient air and an outlet, and a source of vacuumized air, means for selectively connecting said vacuumized air to either said air turbine outlet to drive the rotatable floor cleaning tool whereby the tool may perform a cleaning function on the floor, or to the vacuum pickup device, whereby the pickup device may remove soiled cleaning solution from the floor.

2. The apparatus of claim 1 in which the air inlet to the air turbine is located above the floor.

3. The apparatus of claim 1 in which the means for selectively connecting vacuumized air includes a valve which is responsive to pressure of the cleaning solution.

4. The apparatus of claim 1 in which the means for selective connection of vacuumized air automatically connects vacuumized air to the air turbine whenever cleaning solution is being dispensed to the floor and automatically connects vacuumized air to the pickup device whenever the dispensing of cleaning solution to the floor is stopped.

5. The apparatus of claim 4 further characterized by a manual control to override the automatic means for connecting vacuumized air so that on occasion the vacuumized air can be connected to the turbine although the dispensing of cleaning solution to the floor has been stopped.

6. The apparatus of claim 1 in which the means for selectively connecting vacuumized air includes a manually operable valve.

7. In a scrub head for cleaning a surface and for use with a vacuum wand, a vacuum source communicating to the scrub head through the vacuum wand, means for supplying cleaning solution to a surface to be cleaned, a movable tool in the scrub head for agitating the cleaning solution on the surface, an air turbine in the scrub head having an outlet and an inlet and having its inlet connected to a region of essentially clean ambient air, the air turbine being constructed and arranged to drive the tool, a vacuum pickup device in the scrub head to pick up and evacuate soiled cleaning solution from the surface being cleaned, and means for selectively connecting the vacuum source communicated to the scrub head either to the turbine outlet or to the pickup device so that the turbine will be driven by an air supply that is separate from the air used to convey soiled cleaning solution from the pickup device to the vacuum source.

8. The structure of claim 7 further characterized by having the air inlet to the air turbine located above the surface being cleaned.

9. The structure of claim 7 further characterized by and including means responsive to the supply of cleaning solution for directing the vacuum from the vacuum source to the turbine outlet when the cleaning solution is being supplied or to the pickup device when cleaning solution is not being supplied.

10. The scrub head of claim 9 further characterized in that the means for selective connection of the vacuum source either to the turbine outlet or to the pickup device is automatically responsive to the supply of cleaning solution so that the vacuum from the vacuum source is directed only to the turbine outlet to drive the tool when cleaning solution is being supplied and only to the pickup device when cleaning solution is not being supplied.

11. The scrub head of claim 10 further characterized by and including manually operable means for overriding the automatic means so that the supply of solution may be discontinued and the turbine and tool may continue to be operable.

12. The scrub head of claim 7 in which the means for selective connection of the vacuum source either to the turbine outlet or to the pickup device is manually operable.

* * * * *